United States Patent [19]

Suzuki et al.

[11] Patent Number: 4,498,216

[45] Date of Patent: Feb. 12, 1985

[54] DRAFTING APPARATUS IN A SPINNING FRAME

[75] Inventors: Yoshihisa Suzuki, Chiryu; Yoshiharu Yasui, Toyota; Shigeru Takasu, Kariya, all of Japan

[73] Assignee: Kabushiki Kaisha Toyoda Jidoshokki Seisakusho, Kariya, Japan

[21] Appl. No.: 498,849

[22] Filed: May 27, 1983

[30] Foreign Application Priority Data

May 31, 1982 [JP] Japan ..... 57-092515

[51] Int. Cl.[3] ..... D01H 5/86

[52] U.S. Cl. ..... 19/244; 19/293

[58] Field of Search ..... 19/244, 293, 253, 255, 19/236, 258, 294

[56] References Cited

U.S. PATENT DOCUMENTS 2,193,196 3/1940 Jackson ..... 19/253
3,341,902 9/1967 Yano ..... 19/244
3,748,694 7/1973 Staneff ..... 19/293 X
4,280,252 7/1981 Shlykov et al. ..... 19/255
4,373,233 2/1983 Faure ..... 19/293 X

*Primary Examiner*—Louis K. Rimrodt
*Attorney, Agent, or Firm*—Brooks Haidt Haffner & Delahunty

[57] ABSTRACT

A textile fiber drafting apparatus is disclosed, according to which the drafting bottom rollers in each line along the spinning units of a spinning frame are arranged in such a way that each two adjacently juxtaposed bottom rollers make a single block for each two spinning units, so that each bottom roller has an open, free end through which an apron may be replaced with a new one or fibers entangled on the roller may be removed with extreme ease. Between each such two spinning units is provided an arrangement for driving the bottom rollers thus disposed, including driving and driven mechanisms.

5 Claims, 3 Drawing Figures

DRAFTING APPARATUS IN A SPINNING FRAME

FIELD OF THE INVENTION

The present invention relates generally to a fiber drafting apparatus in a spinning frame. More specifically, it relates to an apparatus for driving the bottom rollers in fiber drafting apparatus in a spinning frame.

BACKGROUND OF THE INVENTION

In textile fiber drafting apparatus in a spinning frame which includes plural sets of paired top and bottom drafting rollers along the corresponding plural number of spinning units of the spinning frame, a group of several bottom rollers, spaced from each other in each of the lines or rows of drafting rollers are mounted on a common shaft, thus constituting a series or a block of bottom rollers, and a plurality of such shafts or series of bottom rollers are connected together thereby to provide an integral structure of bottom drafting rollers for all the spinning units on either side of the spinning frame. The bottom rollers thus arranged in each line are usually driven directly by a driving mechanism disposed in the gear end frame on one end of the spinning machine.

Such conventional arrangement of bottom drafting rollers poses a problem in replacing parts in the drafting apparatus, in particular, the endless aprons or belts which are installed over the bottom rollers in a certain line for transferring fibers while guiding them properly. That is, though old aprons may be removed easily merely by cutting them off, new ones are installed by removing all the bottom rollers for one series from a roller stand, and then fitting the aprons over the rollers while moving them in longitudinal direction of the rollers, which is an extremely troublesome and time consuming operation. Furthermore, in the event of entanglement of fibers around the bottom rollers at their fiber passage portions, it will take much time and labor to remove such fibers therefrom. Since the fibers entangled on the rollers cannot be removed merely by moving them toward the end thereof, it is necessary to cut off the fibers or to disentangle them, which requires a considerable length of time. In addition, fiber lint or fly produced during the drafting and spinning operation and accumulated within the narrow spaces adjacent to the aprons is extremely difficult to remove. This is because the bottom rollers are connected together, forming an integral unit extending all the way along the length of the spinning units disposed on either side of the spinning frame and, therefore, the spaces where the fly is deposited are difficult of access by a fly removing means, due to the space available.

One possible solution for the problem is shown in U.S. Pat. No. 2,193,196 (Jackson) wherein separate roller stands are provided, each having a removable pair of bottom rollers. However, this requires an openable roller stand which also has removable top rollers and, thus, considerable roller adjustment is required when the roller stands are opened to remove the entangled fly. In addition, the roller arrangement permits rapid accumulation of fly so that the roller stands require frequent cleaning.

The problems of fly accumulation and removal have become more acute in view of recent developments in the art of spinning yarns. For example, because it is a very up-to-date process of spinning, a new type spinning machine, which produces a so-called fasciated yarn using a pneumatically-operated false-twist nozzle, has been attracting the interest of the relevant industry in recent years. It is a kind of fluid-jet spinning process which makes possible the production of yarn at a rate more than ten times than that turned out by the conventional ring spinning process. Accordingly, this new spinning process calls for a high draft and, therefore, its drafting apparatus tends to be susceptible to the aforementioned problems which hamper the practical use of such fluid-jet spinning process. That is, its drafting apparatus which operates at an extremely high speed will cause its aprons to wear faster and, under the influence of the accompanying streams of air, the entanglement of fibers around the drafting rollers and the production of fly are more liable to take place during the drafting operation. Though provision may be made to minimize such entanglement of fibers and production of fly, it is highly desirable to provide effective means for facilitating removal of such fibers and fly, if they accumulated, and also to facilitate the replacement of aprons when required to do so.

The apparatus according to the present invention has been conceived with these considerations in mind. Therefore, it is an object of the present invention to provide a drafting apparatus by which removal of fibers entangled on the bottom rollers and fly accumulated adjacent to the aprons is made easier and the necessary replacement from time to time of the endless aprons is greatly facilitated.

It is another object of the invention to provide a drafting apparatus in which the roller driving mechanism is protected against the in ingress of fly thereinto.

It is still another object of the invention to provide a drafting apparatus by which more accurate, drafting, bottom rollers may be manufactured with ease.

BRIEF DESCRIPTION OF THE INVENTION

The foregoing objects are attained by arranging the bottom rollers in the drafting apparatus in such a way that the line of bottom rollers is divided into separate components, each including two rollers for each two adjacent spinning units of the spinning frame, thereby allowing each bottom roller to have an open or free end from which fibers entangled on the roller may be removed, and over which a new apron may be easily installed.

According to the present invention, two sets of bottom rollers are arranged for each two spinning units, and a driven mechanism for the bottom rollers is provided which is operatively engaged with a driving mechanism mounted on a bottom roller driving shaft which is common to all the spinning units on either side of the spinning frame.

In the conventional spinning machine in which the respective bottom rollers are connected together to form an integral unit for all the spinning units on each side of the machine, there has been little problem associated with poor transmission of rotation to the bottom rollers. In the arrangement of bottom rollers according to the invention, however, there is a fear that fly produced during the drafting operation will enter the driven mechanism, thereby hampering the smooth transmission of rotation to the bottom rollers, with the result that steady rotational movement of the rollers will be interfered with.

Accordingly, in its preferred embodiment, a partitioning cover is provided to separate the bottom rollers from their driving and driven mechanisms, which are disposed between each pair of respectively adjacent spinning units.

DETAILED DESCRIPTION OF PREFERRED EMBODIMENTS

Figure 1:
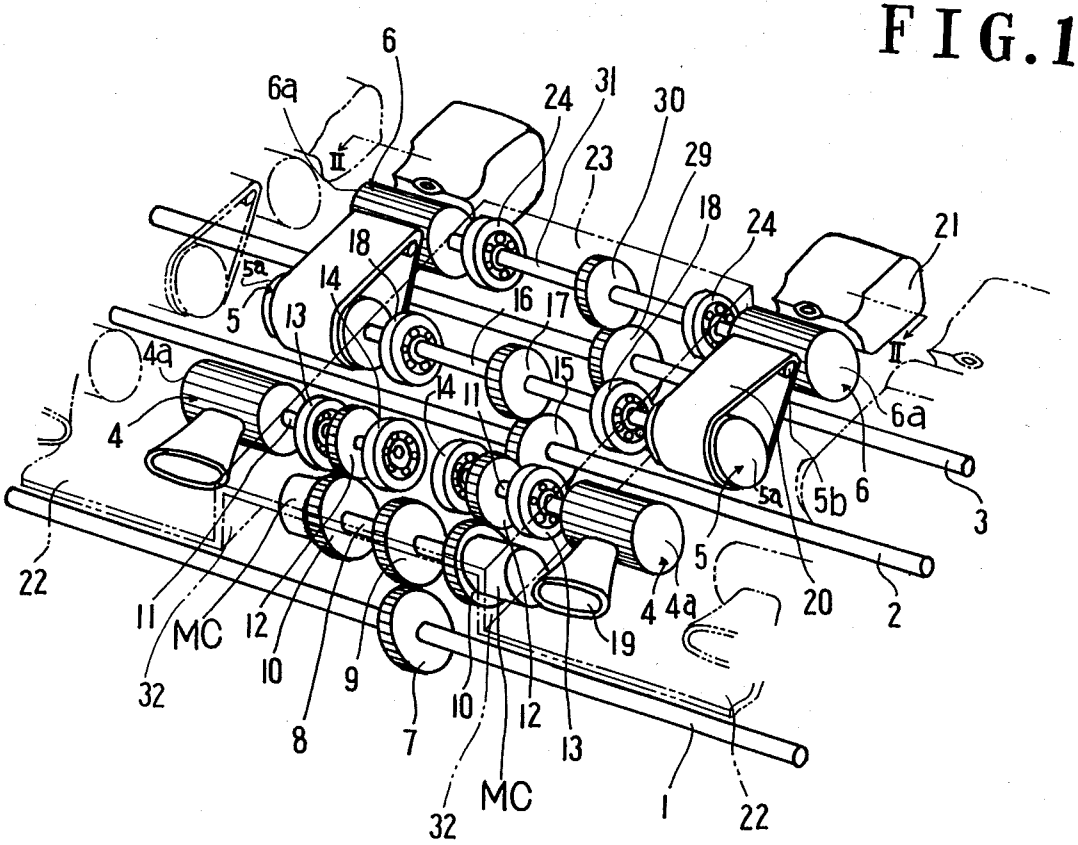
Figure 2:
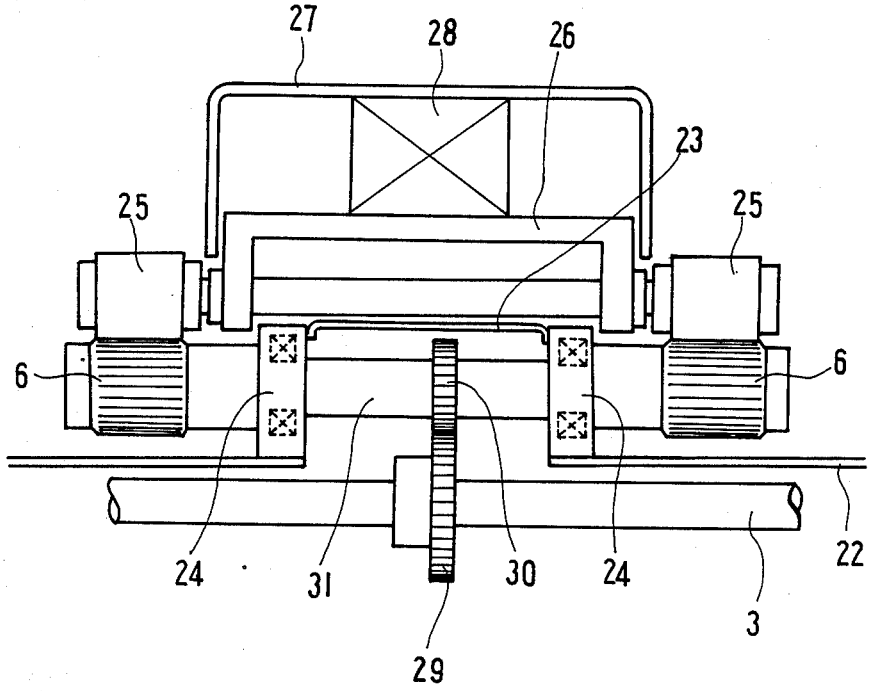
Figure 3:
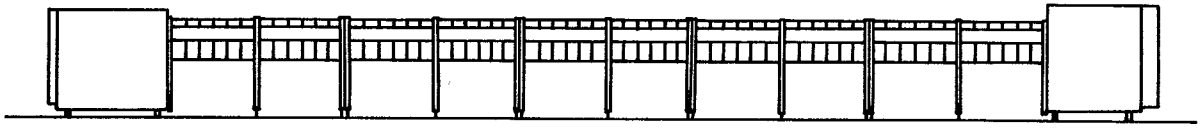

These and other objects, features and advantages of the invention will become apparent to those skilled in the art from the following description of preferred embodiments of fiber drafting apparatus according to the present invention, which description is made with reference to the accompanying drawings, wherein:

FIG. 1 is a partial perspective view showing a fiber drafting apparatus constructed according to the invention, but wherein the top rollers corresponding to the illustrated bottom rollers and some other parts have been removed for the sake of clarity in understanding the invention;

FIG. 2 is a top view of the fiber drafting apparatus of the invention as seen from line II—II in FIG. 1, but including the top rollers omitted from FIG. 1; and FIG. 3 is a front view of the overall spinning machine having the plurality spinning units therealong, and on both sides thereof, and having the drafting apparatus according to the invention incorporated therein and extending the length thereof.

Reference is first made to FIG. 1 which shows a drafting apparatus according to the invention of a so-called three-line type, in which the drafting apparatus has front, middle and back rollers for each spinning unit, and which is used in a spinner for producing a fasciated yarn. Parallel, laterally spaced apart bottom roller driving shafts 1, 2, 3, arranged in rows and driven by a drive (not shown) disposed on one end (or gear end frame) of the spinning machine, are provided and extend along the respective lines of the back bottom rollers 4, the middle bottom rollers 5, and the front bottom rollers 6, all the way along the spinning units provided on one side of the spinning frame. Each of the parallel, laterally spaced rows of bottom rollers 4, 5, 6 is so arranged that a pair of bottom rollers in each line, respectively arranged with each two adjacent spinning units, make a separate block. To rotatably drive the bottom rollers in each such block, a driven mechanism is provided between the two adjacent spinning units which constitute the block, and a driving mechanism, mounted on each of the aforesaid bottom roller driving shafts 1, 2 or 3, is operatively engaged with the driven mechanism.

Referring to the laterally spaced apart back bottom rollers 4, 4, a gear 7 is fixedly mounted on the back bottom roller driving shaft 1 and engages a gear 9 mounted on an intermediate shaft 8. Gears 10, 10 on the opposite ends of the intermediate shaft 8 are in turn engaged with gears 12, 12 on shafts 11, 11 which, respectively, support the back bottom rollers 4. The back bottom roller shafts 11, 11 in the illustrated embodiment are separate shafts, respectively supported by bearings 13, 14. Thus, the rollers 4 are each mounted so that an outwardly facing end 4*a* is open, to facilitate removal of fly, and to facilitate removal of roller 4, itself.

With reference to the middle or intermediate bottom rollers 5, 5, a gear 15 on their driving shaft 2 engages a gear 17 on a middle bottom roller shaft 16, whereby the middle bottom rollers 5 are driven by the driving shaft 2 via the driven shaft 16 which is supported by bearings 18, 18. Thus, as mounted, each rollers has an outwardly facing end 5*a* which is open, so that fly can be easily removed from the roller, and the roller 5 can itself be easily removed.

The pair of front bottom rollers 6, 6 are rotated in the same manner as the middle bottom rollers 5, 5. Namely, a gear 29 mounted on a driving shaft 3 engages another gear 30 on the driven shaft 31, on opposite ends of which the front bottom rollers 6 are fixedly mounted. The driven shaft 31 is journaled on bearings 24, 24. Thus, as in the case of each of the pairs of rollers 4 and 5, the pair of rollers 6 is a driven by driving gears located between them, so that each roller 6 has a free or open end 6*a*, from which it can be easily removed or cleaned.

In the above-described bottom roller driving arrangement the torque of each driving shaft 1, 2, or 3 is transmitted via the driving mechanism 7, 15 and 29 to the driven mechanism 9, 12, 17 and 30.

In the illustrated embodiment of a fiber drafting apparatus, which is specifically incorporated in a spinning system for producing a fasciated yarn by use of an air-operated false-twist nozzle, sliver, roving or the like, supplied through a cone-shaped guide member 19, is transferred over the fiber passageway portions of the back bottom roller 4, on to a moving apron 20, which is mounted so that it spans the space between the middle bottom roller 5 and an apron shaft 5*b*, and thence, over the front bottom roller 6, to a false-twist nozzle 21. Though not shown in FIG. 1, each of the bottom rollers 4, 5, 6 is paired with a mating top roller passed thereagainst, and the sliver or the like is nipped by the paired top and bottom rollers while being transferred, thereby being subjected to drafting action by the rollers.

In the above structure in which a driving mechanism is provided for each two spinning units in the spinning frame, it is possible to provide a means by which each of the spinning units may be stopped and restarted independently of the other, for example, to piece the yarn in the event of a yarn break at either of the spinning units. As exemplified in FIG. 1, such means may be in the form of two magnetic clutches MC, MC mounted on the intermediate shaft 8, in the drive arrangement for the back bottom rollers 4, 4, at its opposite ends in such a way as to selectively interrupt the feeding of sliver to each, for example, in the event of a yarn break.

The addition of roller driving arrangement between each two adjacent spinning units will necessitate means to prevent fly from making ingress into the driving arrangement. Reference is now made to FIG. 2, in which a dust shield in the form of a lower cover 22 is provided beneath each of the bottom rollers 4, 5, 6, and a similar dust shield or upper cover 23 is provided above the driving arrangement 29, 30, 31 in such a way that the rollers and the drive are thereby segregated from each other, so that the driving arrangement is protected against the accumulation of fly which may prevent smooth operation thereof.

As shown in FIG. 2, the bearings 24, 24 which support the front bottom roller shaft 31 on which the driven gear 30 in engagement with the driving gear 29 is mounted, double as the side covers, respectively, to prevent passage of fly from the region of each roller 6 to the drive. Depending upon the structure of the bearings, if there is a fear that attachment of fly to the bearings as a result of oil leakage therefrom would invite further leakage of oil from such bearings, the arrangement may be such that the bearings 13, 14 18 and 24 (FIG. 1) for the respective driven shafts 11, 16 and 31 will be disposed within the area defined by the side covers 32, 32 as shown in FIG. 1 by phantom lines.

Referring again to FIG. 2 which shows a top view as seen from front rollers 6, a weight or pressing member 28 is interposed between a cover 27 and a saddle 26 which supports the top front rollers 25, 25. The weight 28 presses the top rollers 25, 25 against their respectively associated bottom rollers thereby providing nip between them for the fibers to be drafted therebetween. Similar weights, acting on respective saddles in the same way, urge the remaining upper rollers against their respectively associated bottom rollers 4, 4 and 5, 5, for the same purpose.

As it is now apparent to those skilled in the art, the structure according to the present invention, wherein the bottom rollers in each line are divided into separate roller sections, each including two rollers for each two adjacent spinning units of the spinning frame, will permit each bottom roller to have a free, open end, with the resulting advantage that, when renewing its apron, an old one may be removed from the bottom roller merely by moving it sideways and a new one may be installed easily in the same way. Similarly, fibers entangled on the roller or accumulated fly may be taken out from its free end with ease.

Furthermore, the driving and driven mechanisms which are provided between each two adjacent spinning units are disposed in a space separate, and shielded from, the fiber passageway portions formed by the paired top and bottom rollers. Therefore, entrance of fly into the mechanisms may be prevented successfully, thus ensuring smooth and stable rotation of the bottom rollers.

As a further helpful advantage obtainable from the present invention, as a practical matter, it is easier to manufacture the bottom rollers with a high standard of accuracy with the least runout, because each of the bottom rollers may be manufactured substantially as a single unit. This advantage should not be overlooked in the maintenance of good quality of spun yarn from the machine.

While the invention has been illustrated and described with reference to a preferred embodiment, it is to be understood that various modifications in the details of the structure of the apparatus may be made without departing from the spirit and the scope of the invention.

What is claimed is:

1. In drafting apparatus for a spinning frame or the like comprising a plurality of parallel, laterally spaced, rotatable, shaft means, bottom rollers mounted on each of said shaft means, support means for engaging and supporting each shaft means, and drive means for rotating each shaft means, wherein the improvement comprises providing a pair of axially spaced, bottom rollers on each shaft means, one at one end of each respective shaft means and the other at the other end of each respective shaft means with the respective bottom roller of each pair aligned in the same plane with the corresponding respective roller of each other pair, disposing said drive means and said support means between the pair of rollers of each pair and engaging said support means with said shaft means between the rollers of each pair whereby said rollers are unobstructed by said support means and said drive means and have oppositely facing free ends.

2. Drafting apparatus according to claim 1, wherein at least one of said shaft means comprises a pair of axially aligned but spaced apart shafts, each said pair of aligned shafts having a bottom roller mounted thereon at one end thereof, and said drive means comprises a drive shaft, an intermediate shaft, and means providing driving engagement between said drive shaft, said intermediate shaft, and each of said pair of aligned shafts.

3. Drafting apparatus according to claim 1, which further includes engageable clutch means associated with at least one of said shaft means for selectively stopping the rotation of the bottom rollers on the last-mentioned said shaft means.

4. Drafting apparatus according to claim 1, which further comprises dust shielding means disposed between said drive means and said bottom rollers for substantially isolating said drive means from each of said bottom rollers.

5. Drafting apparatus according to claim 1, wherein there are three shaft means, one of said shaft means being a front shaft means carrying a pair of front bottom rollers, a second one of said shaft means being an intermediate shaft means carrying a pair of intermediate bottom rollers and a third one of said shaft means being a rear shaft means carrying a pair of rear bottom rollers, and further comprising an apron shaft associated with each of said intermediate rollers in parallel, laterally spaced relation thereto, each said apron shaft having a free end substantially adjacent to said free end of its said associated intermediate bottom roller, and an apron mounted on and spanning the space between each said apron shaft and its said associated intermediate bottom roller.

* * * * *